US005329212A

United States Patent [19]

Feigleson

[11] Patent Number: 5,329,212

[45] Date of Patent: Jul. 12, 1994

[54] WASTE RECEPTACLE DOOR OPENER

[76] Inventor: Michael J. Feigleson, P.O. Box 907, Centerville, Utah 84014

[21] Appl. No.: 27,889

[22] Filed: Mar. 8, 1993

[51] Int. Cl.[5] ..... B65D 43/00

[52] U.S. Cl. ..... 318/16; 220/260; 318/480

[58] Field of Search ..... 318/16, 280–286, 318/480; 220/260, 263, 283; 49/25, 31, 32, 138, 340, 41, 342, 349, 357

[56] References Cited

U.S. PATENT DOCUMENTS

| | | | |
|---|---|---|---|
| 3,852,592 | 12/1974 | Scoville et al. | 250/221 |
| 3,891,115 | 6/1975 | Ono | 49/25 X |
| 4,729,490 | 3/1988 | Ziegenbein | 220/260 X |
| 4,851,746 | 7/1989 | Milke | 318/480 X |
| 4,888,532 | 12/1989 | Josson | 318/480 |
| 4,996,467 | 2/1991 | Day | 318/480 |
| 5,040,331 | 8/1991 | Meredino et al. | 49/25 |
| 5,181,018 | 1/1993 | Cowie et al. | 49/41 X |

*Primary Examiner*—Jonathan Wysocki

[57] ABSTRACT

A waste receptacle door opener is set forth herein. The waste receptacle's door is automatically opened upon a user's approach and then automatically closed upon the user's departure. The door opening device includes an active infrared proximity sensor for detecting the presence of a user. An electric motor is actuated by a signal generated by the sensor. An actuator arm on the electric motor pulls a flexible cable attached to the door to pull the door open when the motor is activated. The flexible cable allows the door to be opened in the event of a power failure.

7 Claims, 4 Drawing Sheets

WASTE RECEPTACLE DOOR OPENER

BACKGROUND OF THE INVENTION

The present invention relates in general to automated door openers and in particular to a waste receptacle door opener that opens the waste receptacle door automatically when a user approaches.

DESCRIPTION OF THE PRIOR ART

At most fast food restaurants waste receptacles are provided for disposing of trash. These waste receptacles traditionally allow customers the convenience of clearing their own tables. However, because of the way that they operate, they are often difficult to use. The waste receptacles are designed as box-shaped cabinets that stand about waist high and on their front is a covered opening. The covered opening is vertically oriented in the top front portion of the cabinet. The cover is a hinged door that swings freely within the opening. To use the waste receptacle the user pushes inwardly against the door. With the door held back, the user then dumps his trash through the opening into the container. When finished the user releases the door at which point gravity pulls the door back to its closed position. The difficulty in using these waste receptacles is due to the fact that the weight of the receptacle's door is constantly pressing against the user's hand as he holds the door open to dump his trash into the container, and therefore this procedure is both awkward and inconvenient. Also, the door often times is smeared with syrup or sauce which makes this task not only difficult but also unsanitary.

Some known inventions, which are briefly described below, have previously combined door openers with trash containers. However, until the present invention none have addressed the problem of waste receptacles that have a vertically hung door that must be pushed inwardly by hand and held as trash-filled trays are dumped into them.

One known device that incorporates an automatic opener is the Waste Paper Container from Taiichi Ono, (U.S. Pat. No. 3,891,115). Ono's invention is a trash container with a top surface lid that opens downwardly by electronic means. Ono's invention, as it is disclosed, could not be modified to address the problem of waste receptacles whose doors hang vertically and must be opened inwardly. Further, the sensor does not detect the approach of a user but rather detects the presence of trash as it falls into the valley on top of the container. A light beam that crosses the top of the container is broken by the falling trash thereby causing the door to open downward allowing the trash to fall into the container.

Another device that uses an automatic lid opener is the Garbage Container from Jong-Yih Day, (U.S. Pat. No. 4,996,467). Day's invention is a trash container with a top top surface lid that opens upwardly from the top of the container. Therefore, like the previous invention, it also could not be modified, as disclosed, to help with trash receptacles whose doors hang vertically and must be opened inwardly. Also, this invention does not anticipate the possibility of a power failure and the subsequent need to have the trash receptacle still open and close if a power failure should occur.

SUMMARY OF THE INVENTION

It is therefore the principle object of this invention to provide a device that, upon a user's approach, automatically opens vertically hung doors of conventional waste receptacles that are typically used at fast-food restaurants and into which trash-filled trays are normally dumped, and then, upon the user's departure, close the same aforementioned door.

Another object of this invention is to provide a door opening mechanism that in the case of a power failure the opening mechanism would not affect or obstruct the motion of the door and therefore allow the door to still open and close regardless of the device's presence.

Another object of this invention is to provide a door opening device that is self-contained and can be retrofitted to existing waste receptacles.

The foregoing objects can be accomplished by providing a door opening device for waste receptacles that includes an electronic proximity sensor, an electronic control circuit, an electric motor, and a arm assembly. Detection is accomplished by radiating a beam forward via an infrared LED. When an object, such as a person, enters into this beam a reflection of the beam is picked up by a tuned infrared receiver which initiates a triggering signal. The trigger signal, an electronic pulse, is fed to the control circuit which is responsible for several tasks, such as actuating the motor, limiting the angle through which the motor rotates, and allowing a delay to hold the door open while a user is present. A length of arm is attached by cable to an electric motor and as the motor rotates the arm through an 180 degree arc the door is pulled open. The cable that connects the arm to the door is flexible to allow the door to be pushed open according to conventional practice in the event of a power failure.

DETAILED DESCRIPTION OF THE PREFERRED EMBODIMENT OF THE INVENTION

Figure 1:
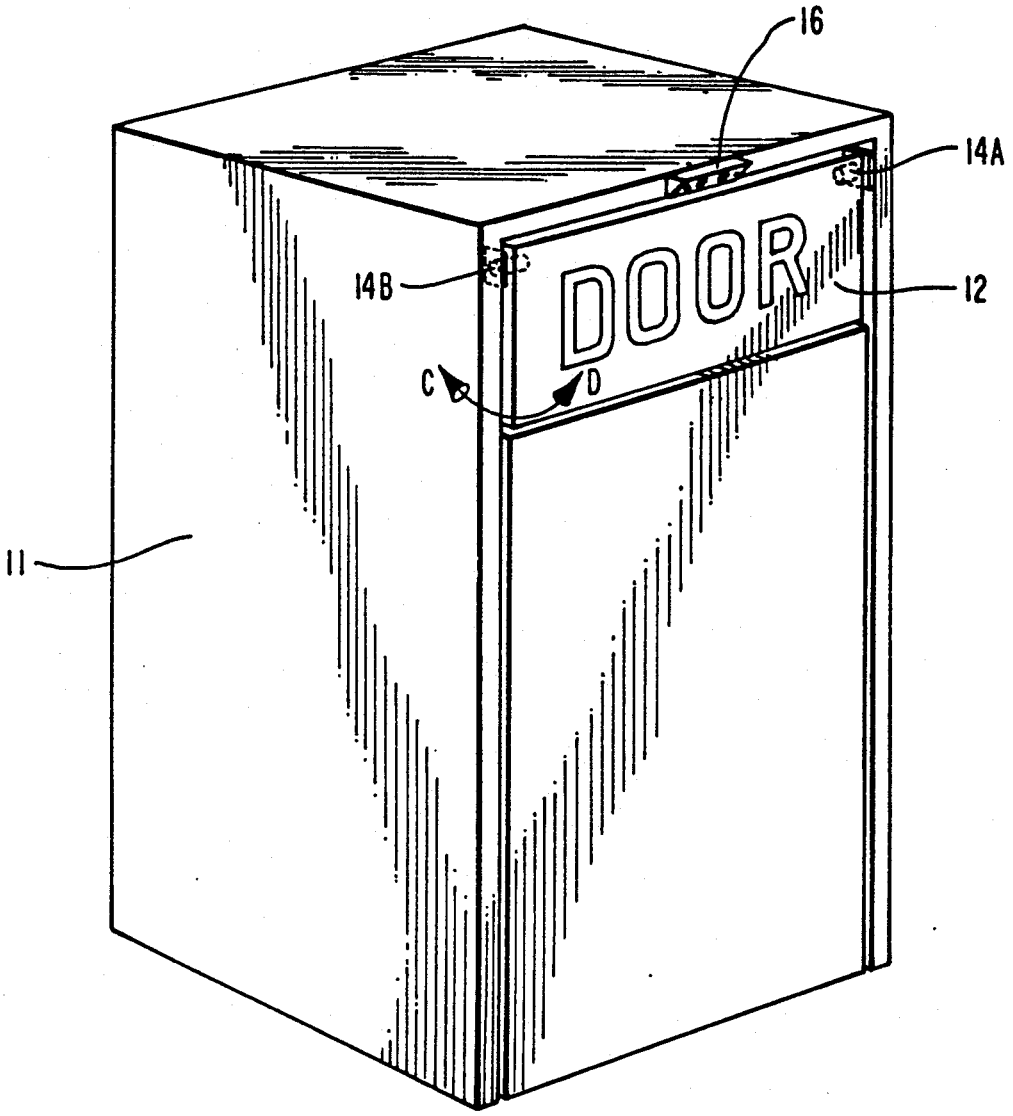
FIG. 1 is a perspective view of a conventional waste receptacle modified with my novel automatic door opener.
Figure 2:
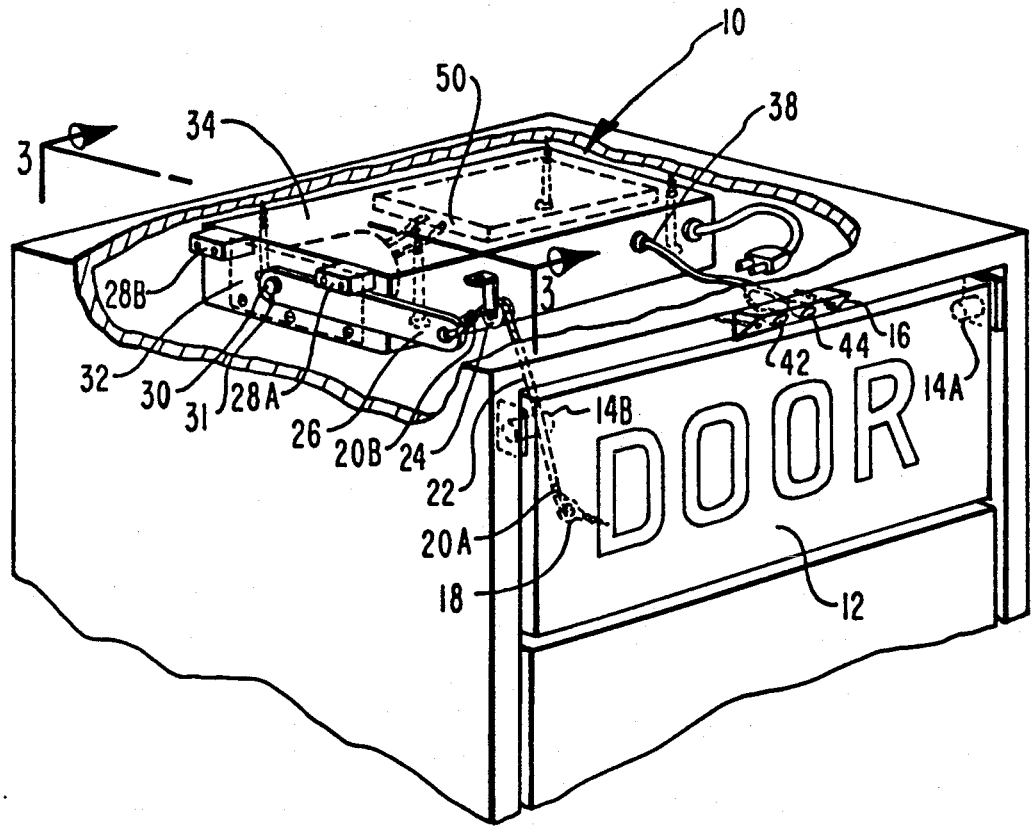
FIG. 2 is an enlarged perspective view of a portion of the waste receptacle of FIG. 1 shown with portions broken away to reveal internal features of my novel invention.
Figure 3:
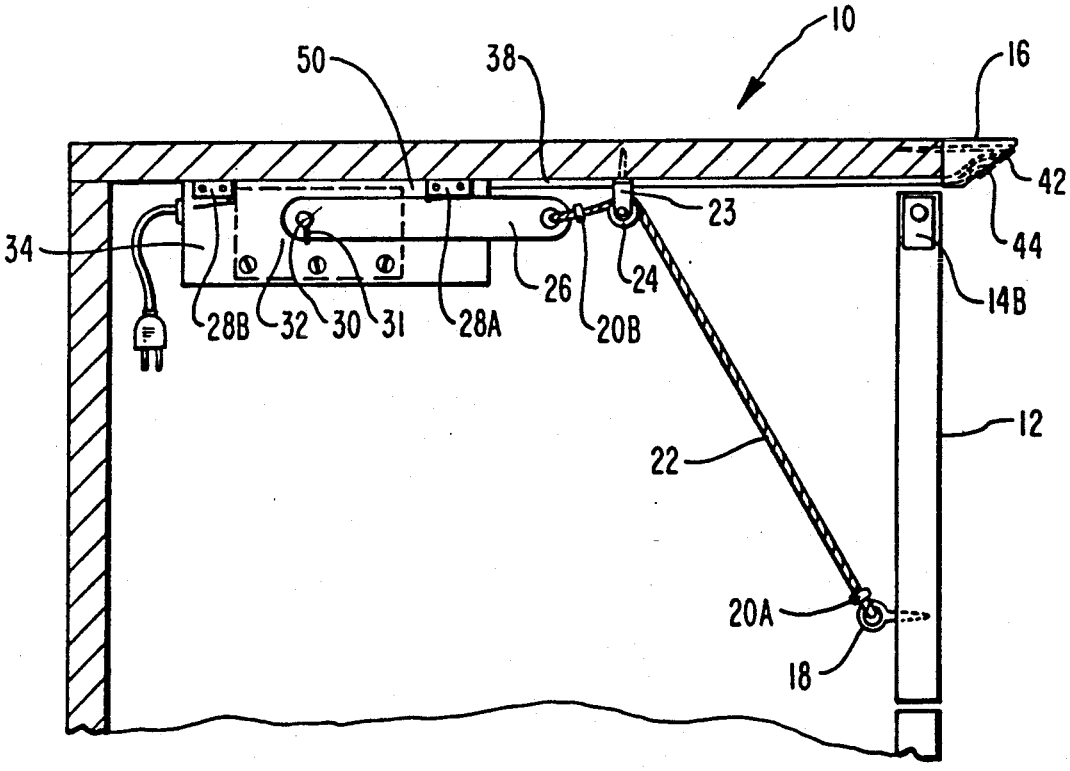
FIG. 3 is a cross sectional view taken along lines 3—3 of FIG. 2.

Referring to FIG. 1, a conventional waste receptacle 11 is shown. Waste receptacle 11 has a vertically hung door 12 that hangs within an opening in the top front portion of waste receptacle 11. Door 12 is hinged by two hinges 14A and 14B at the top corners of door 12. Door 12 swings freely back and forth (arrows C and D) within the opening on hinges 14A and 14B. Conventionally door 12 is pushed inwardly by hand when trash-filled trays (not shown) are dumped into waste receptacle 11. Then conventionally Door 12 returns to the its vertical or closed position by gravity once the user is finished. My novel automatic door opening invention when added to conventional waste receptacle 11 allows users to dump their trash-filled trays into the container without having to contact the waste receptacle door 12.

Referring now to FIGS. 2 through 6, my novel automatic door opener is shown generally at 10 and includes a conventional waste receptacle 11. Automatic door opener 10 includes several key components being: a proximity sensor 16 for detecting the presence of a user, a housing 34, an electronic circuit 50, a rotating arm 26, an electric motor 32, and a flexible cable 22 which allows free movement of door 12 should there be a power failure. Motor 32 is a low voltage, bidirectional, electric motor and uses a well known circuit referred to as an H-Bridge circuit 58 for reversing its direction. The motion of door 12 is shown by arrows C and D (FIG. 4) and the half revolution of arm 26 is shown in sync with door 12 by arrows A and B. However, door 12 can still be opened by hand 60 (FIG. 5) should there be a power failure. Flexible cable 22, which preferably is a small diameter steel cable, attaches to door 12 through an eyelet screw 18 and is held in place by a cable clamp 20A.

The pulling force on cable 22 to open door 12 is achieved using a pulley 24 which attaches to the cabinet by a second eyelet screw 23. Cable 22, after passing over pulley 24, attaches to the arm 26 by a second cable clamp 20B. Arm 26 is mounted to a motor shaft 30 of a DC motor 32 and is secured thereto by a set screw 31.

Rotation of arm 26 through an 180 degree arc in two directions (arrows A and B of FIG. 4) is controlled at the two points where arm 26 stops by limit switches 28A and 28B. Limit switches 28A and 28B are attached and secured to housing 34. Housing 34 houses electronic circuit 50 and electric motor 32. Housing 34 is preferably made of a fire resistant material such as sheet metal or a fire resistant plastic.

The presence of an object (user 60 of FIG. 5) is detected by an active infrared sensor 16 attached on the front edge of waste receptacle 11. Sensor 16 uses an infrared LED 42 which transmits a detection signal 43A. Once an object, such as a person, enters into the range of detection signal 43A, detection signal 43A is reflected back as reflection 43B and received by an infrared detector 44. An electronic pulse is then sent to the control circuit 56 (FIG. 6) via a transmission cable 38.

Figure 6:
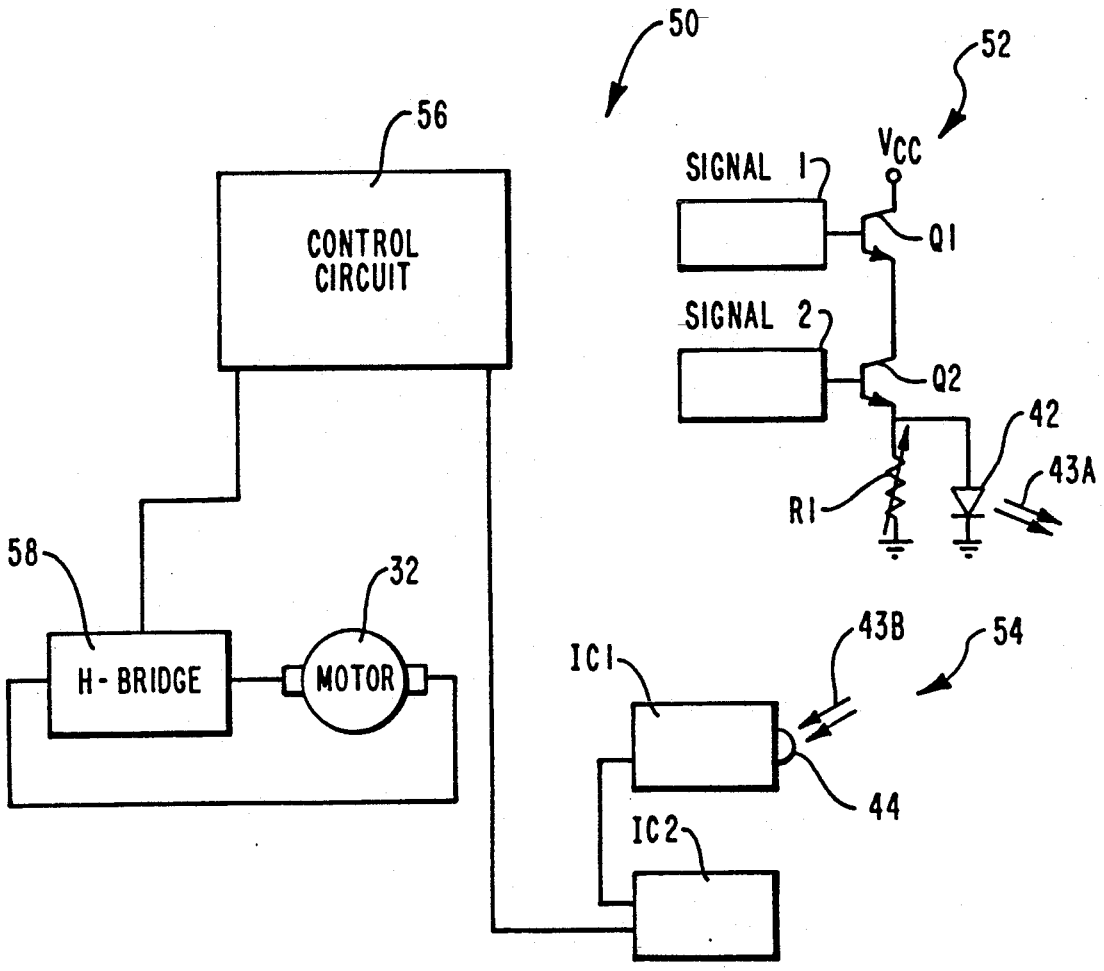
FIG. 6 is a block diagram of the electronic circuitry for my automated door opener.

A block diagram of the electronic circuit 50 is shown in FIG. 6. Electronic circuit 50 consists of four main parts; a transmitter 52; a receiver 54; a control circuit 56; and an H-bridge drive circuit 58.

The transmitter 52 uses a modulated detection signal which is transmitted by the infrared LED 42. The modulated signal is comprised of Signal-1 and Signal-2. The two signals are combined by means of two NPN transistors, Q1 and Q2. Signal-2 is the carrier frequency and Signal-1 is the modulation frequency. A modulated signal is used in this application in order to reduce false triggering of the device. The strength of the signal is adjustable by an adjustable resistor R1.

Receiver 54 is comprised of two commercially available integrated circuits, IC1 and IC2. IC1 is a conventional infrared detection module, and is a combination of an infrared photo transistor, pass band filter, demodulator, and preamplifier. IC2 is an LM567 tone decoder which is available through several manufacturers. When IC2 receives the demodulated signal from IC1, and the signal is within its pass band, an electronic pulse is generated, which is passed on to the control circuit 56 which activates the motor 32.

Figure 4:
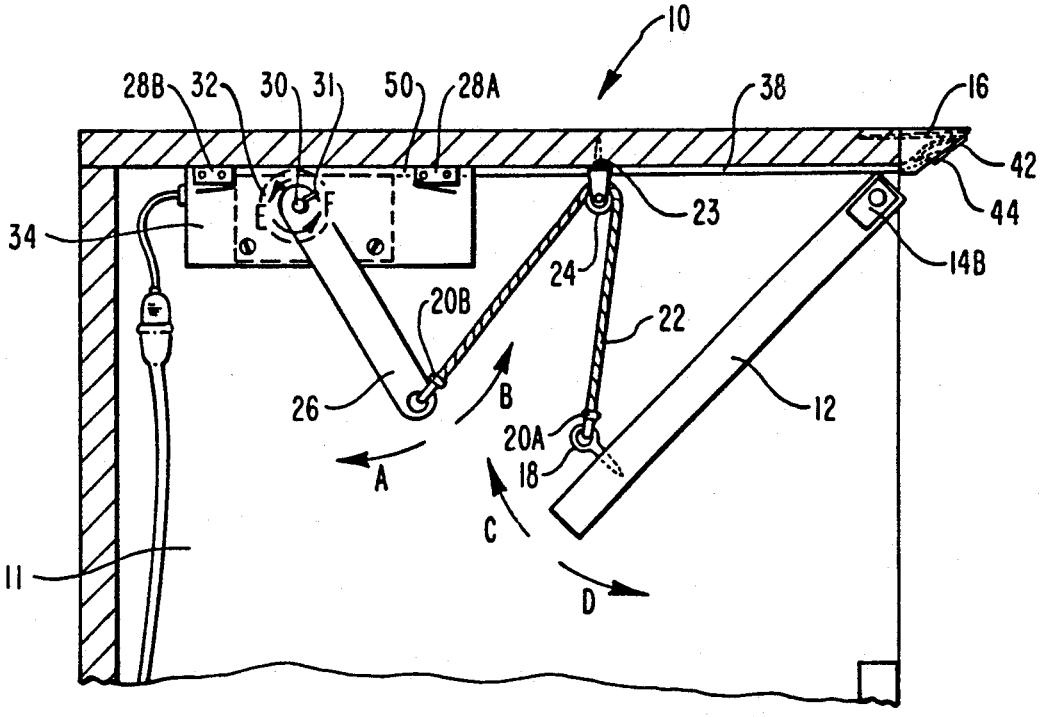
FIG. 4 is the cross sectional view of FIG. 3 with the door being opened upon motion of the arm.
Figure 5:
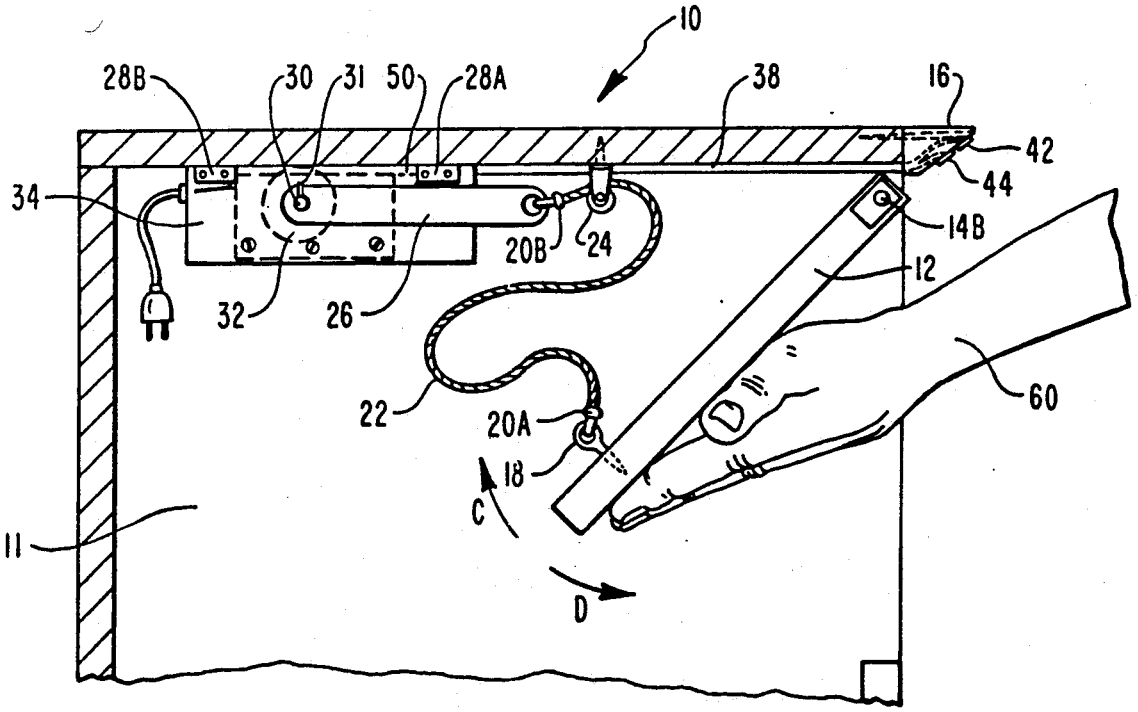
FIG. 5 is the cross sectional view of FIG. 3 shown in the environment of a hand to illustrate the manual opening of the door in the event of a power failure.

The motion of the device is illustrated in FIG. 4. Arrows A and B show the two directions of arm 26 while arrows C and D show the movement of door 12. Cable 22 connects arm 26 to door 12. As arm 26 swings back in the direction of arrow A, door 12 is also pulled back in the direction of arrow C thus opening door 12 and vice versa for closing.

By the aforementioned construction a self-contained automatic door opener 10 is offered. This device works so that when user 60 approaches, proximity sensor 16 detects user 60 and signals the control circuit 56 which signals the H-Bridge circuit 58 which actuates motor 32 to open waste receptacle door 12. Door 12 then remains open as long as user 60 is in front of sensor 16. After departure of user 60, motor 32 reverses and door 12 is closed. Also, as by the aforementioned construction, this automatic door opener 10 attaches to the waste receptacle door 12 by a flexible cable 22 so that door 12 will freely open and close even if automatic door opener 10 should not be working.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An automated door opener for a waste receptacle having an opening and a door hingedly mounted in said opening, the door being oriented in a vertical orientation with a hinge at an upper portion of the door to thereby be pulled by gravitational forces into a closed position unless held in an open position, the door being configurated to open inwardly into the waste receptacle, comprising:

infrared sensor means for sensing the presence of a person within a predetermined proximity to the waste receptacle, said infrared sensor means comprising an infrared transmitter for transmitting a detection signal add an infrared receiver for receiving said detection signal;

electronic controlling means for controlling opening and closing of said automated door opener;

cable means attached to said door for pulling said door inwardly into said waste receptacle, said cable means comprising a cable;

arm assembly means attached to said cable for pulling said cable, said arm assembly means comprising a length of rigid material attached to a drive shaft of said motor;

motor means attached to said arm assembly means in response to said infrared sensor means, said motor means rotating said arm assembly means through an arc, said arm assembly means pulling said cable and thereby opening said door upon proximity of the person to said waste receptacle; and housing means for housing said electronic controlling means within fire resistant confinements.

2. The sensor means defined in claim 1 wherein said infrared transmitter is adjustable for adjusting range of said detection signal.

3. The automated door opener defined in claim 1 wherein said electronic controlling means comprises electronic circuitry for controlling actuation of said motor.

4. The automated door opener defined in claim 1 wherein said arm assembly comprises a length of flexible cable attached between said door and said arm.

5. The automated door opener defined in claim 1 wherein said motor means comprises an electric motor for turning said arm assembly means in two directions.

6. The automated door opener defined in claim 1 wherein said housing means comprises a rigid housing for confining said electronic circuitry within fire resistant confinements.

7. A method for automatically opening a door of a waste receptacle upon approach of a person, the waste receptacle having a vertical opening and a door hinged vertically in the opening, the door being pulled closed by gravitational forces, comprising the steps of:

placing an infrared sensor on said waste receptacle, said infrared sensor sensing the presence of a person within a predetermined proximity to said waste receptacle;

mounting an electric motor to said waste receptacle;

attaching an actuator arm to a drive shaft of said electric motor;

connecting a flexible cable between said door and said actuator arm; and driving said electric motor as a function of a signal produced by said infrared sensor, said electric motor rotating said actuator arm, said actuator arm pulling said cable and thereby opening said door.

* * * * *